US008707871B2

(12) United States Patent
Moon

(10) Patent No.: US 8,707,871 B2
(45) Date of Patent: Apr. 29, 2014

(54) SELF-STEERING DEVICE FOR RAILWAY VEHICLE

(75) Inventor: Kwang Soon Moon, Seoul (KR)

(73) Assignee: Korea Interfacial Science and Engineering Institute, Seoul (KR)

( * ) Notice: Subject to any disclaimer, the term of this patent is extended or adjusted under 35 U.S.C. 154(b) by 0 days.

(21) Appl. No.: 13/701,453

(22) PCT Filed: Sep. 7, 2010

(86) PCT No.: PCT/KR2010/006066

§ 371 (c)(1),
(2), (4) Date: Nov. 30, 2012

(87) PCT Pub. No.: WO2011/152592

PCT Pub. Date: Dec. 8, 2011

(65) Prior Publication Data

US 2013/0068126 A1 Mar. 21, 2013

(30) Foreign Application Priority Data

Jun. 3, 2010 (KR) ..... 10-2010-0052402

(51) Int. Cl.
*B61D 1/00* (2006.01)

(52) U.S. Cl.
USPC ..... 105/167; 105/157.1; 104/245

(58) Field of Classification Search
USPC ..... 104/244, 47; 105/167
See application file for complete search history.

(56) References Cited

U.S. PATENT DOCUMENTS 3,648,617 A * 3/1972 Metzner et al. ..... 104/94
3,763,789 A * 10/1973 Olson et al. ..... 105/72.2
4,275,660 A * 6/1981 Forster ..... 104/247

(Continued)

FOREIGN PATENT DOCUMENTS

JP 56-082662 A 7/1981
JP 57-031272 U 2/1982
JP 06-329022 A 11/1994

OTHER PUBLICATIONS

International Search Report, mailing date Jul. 27, 2011, for corresponding International Application No. PCT/KR2010/006066 with English translation.

*Primary Examiner* — Jason C Smith
(74) *Attorney, Agent, or Firm* — Intellectual Property Law Group LLP

(57) ABSTRACT

The present invention relates to a self-steering device for a railway vehicle, which includes axles installed on a truck supporting a vehicle body of the railway vehicle, wheels, each of which is connected to the axle and has a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section, and guide rollers, each of which is in rolling contact with a top surface edge or a lateral surface of the rail in front or to the rear of the wheel when the railway vehicle enters curved rails and supports a greater transverse load than the interference section. The guide rollers can be directly installed on the railway vehicle or at least one of the vehicle body, the truck, and the axle.

18 Claims, 10 Drawing Sheets

(56) References Cited

U.S. PATENT DOCUMENTS

| | | | | |
|---|---|---|---|---|
| 5,115,746 | A | 5/1992 | Scarpatetti | |
| 6,523,481 | B2 * | 2/2003 | Hara et al. | 105/141 |
| 8,161,889 | B2 * | 4/2012 | Morichika et al. | 105/72.2 |
| 8,353,248 | B2 * | 1/2013 | Kurahashi et al. | 105/215.2 |
| 8,381,660 | B2 * | 2/2013 | Kurahashi et al. | 105/215.2 |
| 2009/0293758 | A1 * | 12/2009 | Timan | 104/245 |
| 2012/0103227 | A1 * | 5/2012 | Maeyama et al. | 104/245 |
| 2013/0068126 | A1 * | 3/2013 | Moon | 105/157.1 |

* cited by examiner

SELF-STEERING DEVICE FOR RAILWAY VEHICLE

TECHNICAL FIELD

The present invention relates, in general, to a self-steering device for a railway vehicle and, more particularly, to a self-steering device for a railway vehicle, capable of reducing the wear and squealing noise of a wheel caused by friction, and improving a running speed and running stability during curved movement.

BACKGROUND ART

FIG. 1 is a side view of a typical railway vehicle. As shown, the railway vehicle 1 is made so as to travel on rails 3, and has a basic structure made up of wheels 2, trucks 4, a vehicle body 5, and accessories.

The vehicle body 5 is a portion that is used to transport passengers, forms a shape of the vehicle, and exists in various types according to the purpose. The railway vehicle 1 is divided into various types such as locomotives, passenger vehicles, and freight vehicles.

The wheels 2 are each formed of special steel, and are fixed to respective opposite left and right hand ends of an axle 6. Typically, two pairs of wheels 2 are coupled to construct one truck 4. In the case of the locomotive, three or more pairs of wheels 2 may be installed on one truck 4. Further, two trucks 4 are generally installed on one railway car.

Each truck 4 is configured to be coupled with the vehicle body 5 at the middle part thereof by a pin so as to be able to rotate relative to the vehicle body 5 at a predetermined angle. This is intended to cause the trucks 4 coupled to the same vehicle body 5 to have rotatability when fitted to the curvature of the respective rails 3 during curved movement.

Each wheel 2 plays a crucial role in the safe service and the running speed of the railway vehicle. The wheel 2 is structurally made up of a wheel tread 22 that is in rolling contact with a top surface of the rail 3, and a wheel flange 21 corresponding to a step protruding from the wheel tread 22 in order to prevent derailing during curved movement.

Each truck 4 is a part which supports the vehicle body 5 and on which the axle 6 and the wheels 2 are installed. Each truck 4 should have a bearing force capable of withstanding high-speed operation and load, and be equipped with suspension including a damping device and braking devices. Generally, one of the most difficult problems with truck design for the railway vehicle 1 is that two contradictory requirements must be satisfied, that is, the truck 4 must enable the railway vehicle 1 to move safely at high speed while moving on straight rails, and prevent the vehicle from derailing while moving on curved rails.

FIG. 2 is an explanatory view showing the cause of squealing noise. FIG. 3 is a side view showing a contact surface of a wheel flange 21 and a rail 3 in the related art. Referring to FIGS. 2 and 3, due to a centrifugal force generated when the railway vehicle 1 moves along a curve, the danger of the vehicle derailing is increased, and the wear of the wheels 2 or the rails 3 is increased. Thus, the maintenance expenses of the rails 3 are increased. Further, the squealing noise generated greatly reduces the riding comfort.

When the railway vehicle 1 moves along a curve, a transverse load is generated due to the centrifugal force. The transverse load greatly increases frictional forces Fx and Fz on a contact surface of a lateral surface 3*d* of the rail 3 and the wheel flange 21. The frictional forces are transmitted to passengers as "screechy" high-frequency noise. The frictional forces Fx and Fz greatly increased by the centrifugal force compared to the straight moving wear down the wheels 2 or the rails 3 on curved portions, and cause a severe squealing noise.

This problem increases in proportion to the centrifugal force, and becomes more serious when a high-speed train moves along the curved rails 3 or when the curvature of the curve is very great, even in the case of a low-speed train such as a subway train.

DISCLOSURE

Technical Problem

As a result of examining a structure of the conventional wheel shown in FIGS. 1 to 3, it was discovered that it would be possible to reduce the wear of the wheel 2 and the squealing noise if the transverse load applied between the wheel flange 21 and the rail 3 during curved movement could be reduced, and from this the basic idea of the present invention was derived.

In general, the railway vehicle 1 is prevented from derailing when the wheel flange 21 interferes with the lateral surface 3*d* of the rail 3 during straight movement. However, since the transverse load Fc caused by the centrifugal force is applied to a portion where the wheel flange 21 and the rail 3 undergo contact interference during curved movement, a problem that the wear and noise of the wheel 2 caused by an increase in frictional force are increased occurs by itself.

Since the centrifugal force is not applied during straight movement, the wear or noise generated from the contact surface of the wheel flange 21 and the rail 3 is not in serious question. However, since the centrifugal force is applied during curved movement, the wear or noise generated when the wheel flange 21 comes into contact with the rail 3 becomes an issue.

Since the transverse load Fc caused by the centrifugal force cannot be basically eliminated, it is the point of the present invention to derive a structure in which the transverse load Fc is prevented from being applied to the contact portion of the wheel flange 21 and the rail 3 during curved movement. To this end, the present invention suggests a structure in which a guide roller 122 is installed apart from the wheel flange 21 so as to support the transverse load Fc.

FIGS. 4 to 6 are schematic views for explaining various considerations when the guide roller 122 is installed as a virtual embodiment compared with the present invention.

First, referring to FIG. 4, there is shown a virtual embodiment in which a pair of wheels 2 are disposed in the front and rear of a truck 4 in a lengthwise direction of the truck 4 which corresponds to a moving direction of a railway vehicle 1, and in which a guide roller 122 is disposed between the pair of wheels 2. The guide roller 122 of this structure cannot basically solve a problem that a wheel flange 21 comes into contact with a lateral surface 3*d* of a rail 3 to form a squealing noise generating portion N during curved movement.

Next, referring to FIG. 5, there is shown a virtual embodiment in which a guide roller 122 is disposed only in the front of a truck 4. Even in this case, a problem that a wheel flange 21 of a wheel 2 located in the rear of the truck 4 comes into contact with a lateral surface 3*d* of a rail 3 to form a squealing noise generating portion N cannot be solved.

Further, referring to FIG. 6, there is shown a virtual embodiment in which a guide roller 122 is disposed in the front of a truck 4 and another guide roller 122 is disposed between a pair of wheels 2. Even in this case, a problem that a wheel flange 21 of the wheel 2 located in the rear of the truck 4 comes into contact with a lateral surface 3*d* of a rail 3 is not solved.

Accordingly, the present invention has been made keeping in mind the above problems occurring in the related art, and is intended to provide a self-steering device for a railway vehicle, which secures a self-steering capability of the railway vehicle, allows the railway vehicle to move on tracks having many curves at high speed, and can essentially prevent wear and squealing noise of a wheel or a rail even when a curvature of a curve, as in an urban subway, is very great.

Technical Solution

As an embodiment, the present invention provides a self-steering device for a railway vehicle, which includes: axles installed on a truck supporting a vehicle body of the railway vehicle; wheels connected to the axles, and each having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section; and guide rollers, each of which is in rolling contact with a top surface edge or a lateral surface of the rail in front or to the rear of the wheel when the railway vehicle enters curved rails and supports a greater transverse load than the interference section.

As an embodiment, the present invention provides a self-steering device for a railway vehicle, which includes: axles installed on a truck supporting a vehicle body of the railway vehicle; wheels rotating around the respective axles, running along a rail, and each having a protruding wheel flange facing a lateral surface of the rail to prevent the railway vehicle from derailing; and guide rollers disposed respectively in the front and rear of the truck in a lengthwise direction of the railway vehicle with the wheel between them.

Here, when a radius of curvature of the rail is reduced, the guide roller may support a transverse load of the railway vehicle, and the wheel flange may be separated from the rail.

Advantageous Effects

According to the present invention, during curved movement, the guide roller supports the transverse load in contact with the top surface edge or the lateral surface of the rail. As such, in comparison with a conventional case in which the transverse load is supported only by the wheel flange, the self-steering capability of the railway vehicle is improved, and a derailing possibility of the railway vehicle is prevented.

Further, the railway vehicle can move at high speed even on a railway that has many curves. When a curvature of a curve is very great, as in an urban subway, the wear and squealing noise of the wheel or rail can be reliably prevented. Thus, the riding comfort and stability can be improved.

Further, since a contact point or line of the rail and the guide roller is formed so as to be identical to a direction of centrifugal force, the guide roller can sufficiently support the transverse load even when it has a small outer diameter. Thus, the guide roller can easily pass through the connection gap formed in a junction of the rails.

In addition, a controller raises/lowers the guide roller. The controller can automatically control the guide roller so as to be in contact with or be separated from the rail. Thus, even when a size of the guide roller is increased, the passing of the connection gap is not restricted. To make the guide roller to be in contact with the rail only during curved movement, the prevention of wear and the improvement of reliability of the guide roller can be expected.

MODE FOR INVENTION

Figure 1:
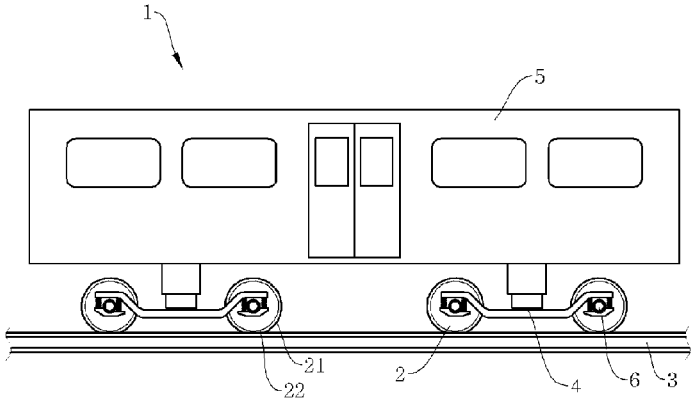
FIG. 1 is a side view of a typical railway vehicle.

Reference will now be made in greater detail to exemplary embodiments of the invention with reference to the accompanying drawings. In the drawings, the sizes or shapes of components may be exaggerated for clarity and convenience. Further, technical terms, as will be mentioned hereinafter, are terms defined in consideration of their function in the present invention, which may be varied according to the intention of a user, practice, or the like, so that the terms should be defined based on the contents of this specification.

Figure 7:
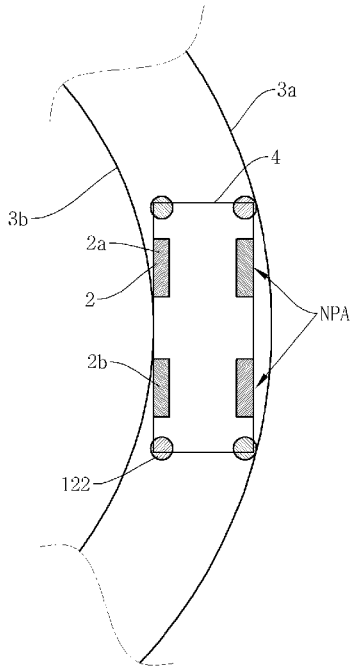
FIG. 7 is a schematic view that explains a structure in which guide rollers of the present invention are installed.

FIG. 7 is a schematic view that explains a structure in which guide rollers 122 of the present invention are installed. Referring to FIG. 7, a self-steering device for a railway vehicle according to an exemplary embodiment of the present invention is configured so that all wheels 2 are disposed between a pair of guide rollers 122 in a lengthwise direction of a truck 4. Thereby, a transverse load is supported by wheel flanges 21 as well as the guide rollers 122 during curved movement.

When the pair of guide rollers 122 are in contact with a rail 3 during curved movement, the wheels 2*a* and 2*b* disposed between the guide rollers 122 are separated from the rail 3. Thus, a squealing noise prevention area NPA is naturally formed by a geometrical disposition structure.

Figure 8:
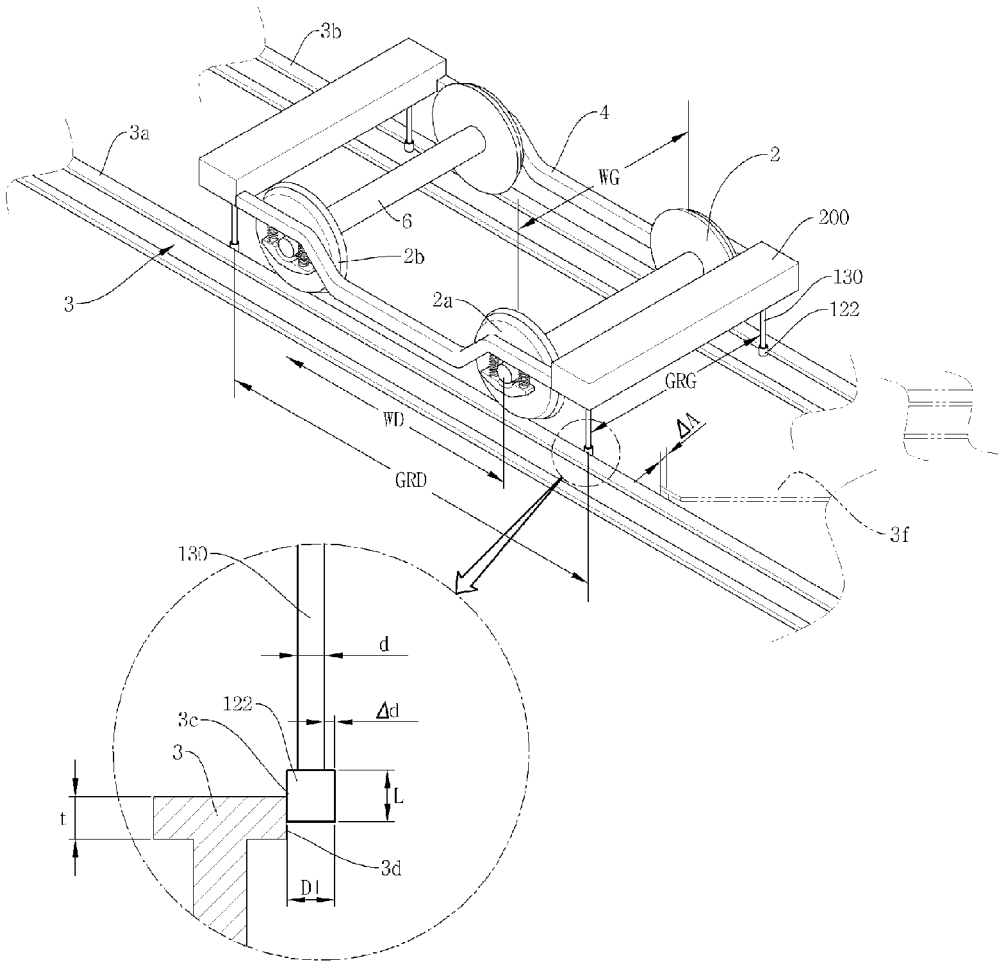
FIG. 8 is a perspective view showing a self-steering device for a railway vehicle according to an embodiment of the present invention.

FIG. 8 is a perspective view showing a self-steering device for a railway vehicle according to an embodiment of the present invention. Referring to FIGS. 7 and 8, the self-steering device for a railway vehicle according to the embodiment of the present invention includes axles 6, the wheels 2, and the guide rollers 122.

The axles 6 are installed on the truck 4 supporting a vehicle body 5 of the railway vehicle 1, and function as rotational centers of the wheels 2. Excepting a special case, two axles 6 are disposed at one truck 4 parallel with each other in a moving direction of the railway vehicle 1. In the case of a locomotive, three axles 6 may be installed on one truck 4.

Each wheel 2 includes a wheel tread 22 and a wheel flange 21. The wheel tread 22 moves on a top surface of the rail 3, and supports a vertical load of the railway vehicle 1 regardless of straight and curved movement. The wheel flange 21 is in contact with a lateral surface of the rail during straight movement of the railway vehicle 1, thereby forming an interference section 30 and functioning to prevent the railway vehicle 1 from derailing.

Each guide roller 122 supports greater transverse load than an interference section 30 of the wheel flange 21 when the railway vehicle 1 enters the curved rails 3. Especially, when the railway vehicle 1 enters the curved rails 3, the guide roller 122 comes into rolling contact with a top surface edge 3*c* of the outer rail 3*a* or the lateral surface 3*d* of the outer rail 3*a* in front or to the rear of the wheel 2.

When a radius of curvature of the rail 3 is reduced, the guide roller 122 supports the transverse load of the railway vehicle 1, and the wheel flange 21 is separated from the outer rail 3*a*. The guide roller 122 separates the wheel flange 21 from the lateral surface 3*d* of the rail 3 during curved movement of the railway vehicle 1.

In the present invention, the wheel flange 21 is not separated by an external force such as hydraulic pressure or electromagnetic force, but by the geometrical disposition structure of the wheels 2 and the guide rollers 122. Thus, the present invention can realize the self-steering device having high reliability in a simple structure.

As schematically shown in FIG. 7, the geometrical disposition structure is designed to dispose the guide rollers 122 in front of the wheel 2 located at the foremost front of the truck 4 and to the rear of the wheel 2 located at the rearmost rear of the truck 4, respectively.

That is, as shown in FIG. 8, when the first and second wheels 2*a* and 2*b* are sequentially arranged from the front of the truck 4, the guide rollers 122 are disposed in front of the first wheel 2*a* and to the rear of the second wheel 2*b*, respectively.

The present invention is not limited to the shown structure. When three axles are arranged on one truck and first, second, and third wheels are sequentially arranged from the front, the guide rollers may be disposed in front of the first wheel and to the rear of the third wheel, respectively.

Figure 2:
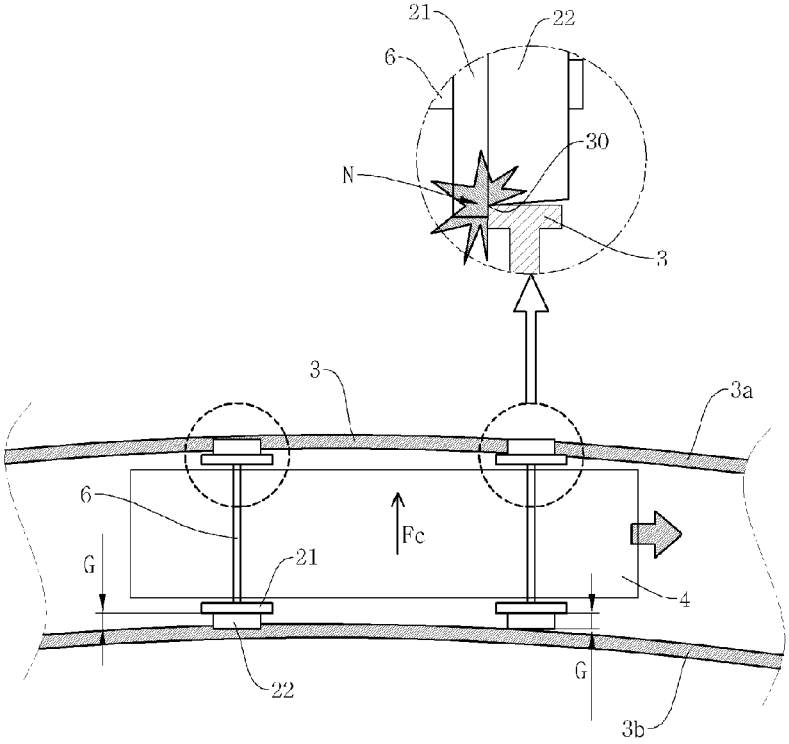
FIG. 2 is an explanatory view showing the cause of squealing noise.
Figure 3:
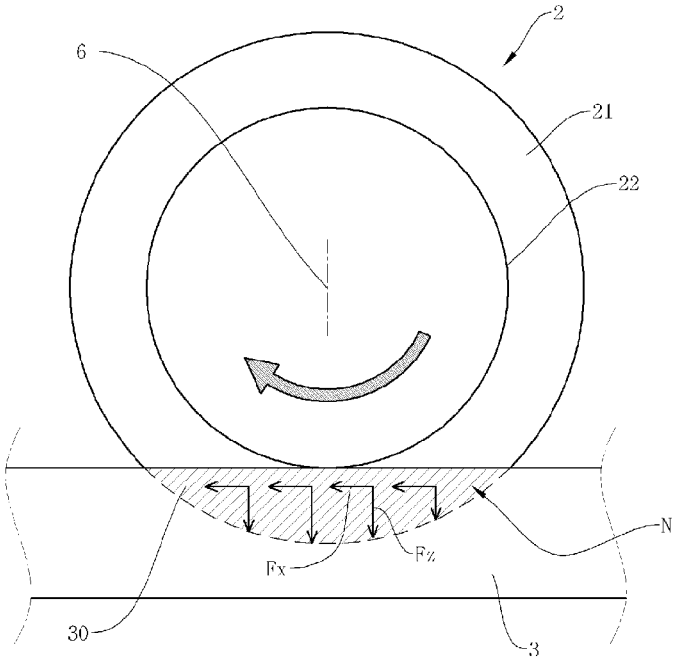
FIG. 3 is a side view showing a contact surface of a wheel flange and a rail in the related art.
Figure 4:
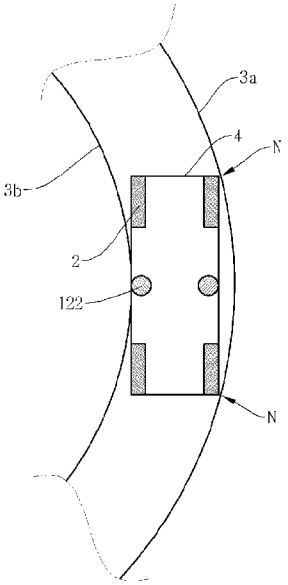
FIGS. 4 to 6 are schematic views for explaining various considerations when the guide roller 122 is installed as a virtual embodiment compared with the present invention.
Figure 5:
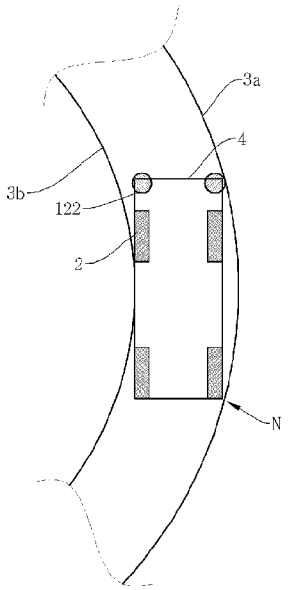
Figure 6:
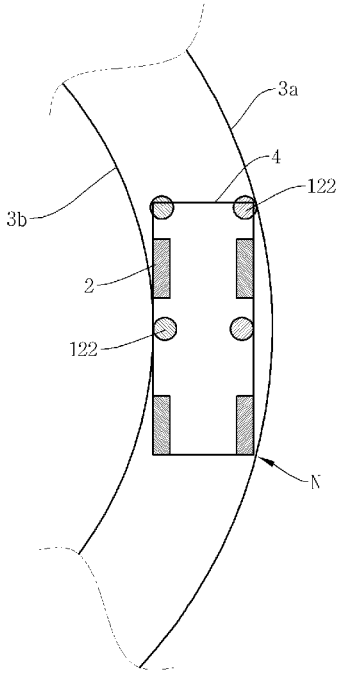

Further, since the guide roller 122 is in rolling contact with the rail 3, the guide roller 122 is in point contact with the top surface edge 3*c* of the rail 3 or is in line contact with the lateral surface 3*d* of the rail 3. That is, the guide roller 122 is not in surface or sliding contact with the top surface edge 3*c* or the lateral surface 3*d* of the rail 3, unlike the wheel flange 21. Although the interference section 30 (FIGS. 2 and 30 of FIG. 3) or the frictional surface actually exists at the guide roller 122 as well as the rail 3, the frictional surface has a very small area, compared to that of the wheel flange 21.

Thus, even when the transverse load is caused by a centrifugal force as in the related art, the frictional surface of the guide roller 122 is extremely small. As such, a chance of the frictional force caused by the transverse load being greatly applied is removed. Since the frictional force is suppressed, a possibility of wear of the guide roller 122 and squealing noise caused by the guide roller 122 is remarkably low compared to the wheel flange 21.

In the related art, due to an increase in frictional force caused by the transverse load Fc at the interference sections 30 (FIGS. 2 and 30 of FIG. 3) of the guide roller 122 and the rail 3, the wear of the wheel flange 21 and the squealing noise are generated.

However, the present invention radically prevents the problems of the related art on the basis of two configurations: a geometrical configuration in which the guide rollers 122 are installed in front and to the rear of the wheel 2 in a lengthwise direction of the railway vehicle 1; and a configuration in which the guide roller 122 is in rolling contact with the rail 3 in point or line contact state. As a most basic embodiment, when a rotational shaft of the guide roller is installed so as to be perpendicular to the lateral surface or the top surface edge of the rail (FIGS. 8, 9, 10, 12, 14 and 15), the guide roller is in point or line contact with the lateral surface or the top surface edge of the rail. Thus, the friction surface is originally removed, so that the purpose of removing the squealing noise can be radically achieved. However, if the guide roller 122 is installed so as to be inclined with respect to the lateral surface of the rail, the original purpose such as the removal of the frictional surface and the removal of the squealing noise can be achieved only when the guide roller 122 is in point contact with the top surface edge of the rail as in FIG. 13. Unlike this structure, when the rotational shaft of the guide roller is installed so as to be inclined to the rail, the guide roller may be in surface contact with one of the lateral surface, the top surface edge, and the top surface of the rail. In this case, the frictional surface is not radically removed. This becomes an unfavorable embodiment distinguished from the embodiment of the present invention. That is, the present invention has a structure in which the guide roller is in point or line contact with the rail rather than in surface contact with the rail, so that the frictional surface between the guide roller and the rail is not originally generated.

As an embodiment shown in FIG. 8, the rotational shaft 130 of the guide roller 122 is perpendicular to the axle 6 or is parallel to the lateral surface 3*d* of the rail when viewed from the front of the railway vehicle 1. When a connection gap ΔA is formed in an intersection of one rail 3 and another rail 3*f* so that the wheel flange 21 can pass through, the guide roller 122 has a smaller outer diameter than the connection gap ΔA.

The guide roller 122 and its rotational shaft 130 may be installed on the truck 4 or the wheel 2, or be directly installed on the railway vehicle 1 or the vehicle body 5.

In detail, referring to FIG. 8, a turnout device is installed on a junction at which the track is divided in two directions or the tracks are joined in one direction. The turnout device includes a point section converting the railway vehicle 1 in a direction that is intended to send the railway vehicle 1, a crossing section in which two tracks intersect on the same plane, and a lead section located between the point section and the crossing section.

The point section has a predetermined angle at a position where two rails 3*a* and 3*f* intersect. The crossing section provides a disconnected portion (referred to as "connection gap ΔA") between the two rails 3*a* and 3*f* so that the wheel flange 21 can pass through. A size of the connection gap ΔA is less than about 10 cm. Referring to FIG. 8, since the guide roller 122 can pass through the connection gap ΔA, there is a limitation that the outer diameter of the guide roller 122 cannot exceed 10 cm.

Meanwhile, during curved movement, the wheel flange 21 is separated from the lateral surface 3*d* of the rail 3 by the guide roller 122, but the tread of the wheel 2 is not separated from the top surface of the rail 3. Thus, the guide roller 122 supports only the transverse load of the railway vehicle 1, and does not need to support the vertical load of the railway vehicle 1. Unlike the wheel tread 22 that should support the vertical load considerably greater than the transverse load, the guide roller 122 of the present invention supports only the transverse load. As such, the guide roller 122 can be installed in a very small size compared to the wheel 2, and also becomes free in selection of a material or heat treatment conditions compared to the wheel 2.

Thus, even when the outer diameter of the guide roller 122 is designed so as to be smaller than the connection gap ΔA (e.g. even when the outer diameter of the guide roller 122 is designed so as to be less than 10 cm), the guide roller 122 can sufficiently support the transverse load.

An example of the guide roller 122 may include a needle bearing. The needle bearing includes an inner race fitted around an end of the rotational shaft 130 and an outer race being in rolling contact with the lateral surface 3*d* of the rail, and has an advantage in that a size difference 2Δd between an inner diameter d of the inner race and an outer diameter D1 of the outer race is very small compared to typical bearings. That is, the needle bearing is a rotary support that, despite a very thin thickness Δd, can withstand a sufficient load and undergo an increase in inner diameter and a decrease in outer diameter D1. When the inner diameter d of the guide roller 122 is increased, the outer diameter d of the rotational shaft 130 can be increased, so that the reliability of the transverse load can be improved. Even when a length L of the guide roller 122 is increased, the reliability of the transverse load can be improved without interfering with the connection gap ΔA.

A shape of the guide roller 122 is a cylinder shape, a cone shape, a truncated cone shape, or a combined shape of the cylinder shape and the cone shape. The guide roller 122 of the cylinder shape is shown in FIG. 8.

The rotational shaft 130 of the guide roller 122 is perpendicular to the axle 6 or is parallel to the lateral surface 3*d* of the rail when viewed from the front of the railway vehicle 1. Sine the maximum outer diameter D1 of the guide roller 122 is smaller than the connection gap ΔA, the guide roller 122 can pass through the connection gap ΔA without interference although the rotational shaft 130 of the guide roller 122 is not raised when the guide roller 122 meets the connection gap ΔA.

Meanwhile, the present invention is not dependent on a disposition relation of the wheel flange 21 and the guide roller 122 in a transverse direction of the railway vehicle 1 as a rule. That is, even when the guide roller 122 and the wheel flange 21 are arranged on a straight line when viewed from the front or rear of the railway vehicle 1, both the wheel flange 21 and the guide roller 122 are in contact with the lateral surface 3*d* of the rail 3 during straight movement. Further, during curved movement, the wheel flange 21 is separated from the lateral surface 3*d* of the rail 3, and only the guide roller 122 is in contact with the lateral surface 3*d* of the rail 3.

However, in the embodiment in which the wheel flange 21 and the guide roller 122 are arranged on a straight line when viewed from the front or rear of the railway vehicle 1 in this way, when the guide roller 122 is in rolling contact with the lateral surface 3*d* of the rail 3 during straight movement, the guide roller 122 may be unnecessarily worn. As such, additional measures of this situation are taken.

That is, in another embodiment of the present invention, an embodiment in which the guide roller 122 is separated from the lateral surface 3*d* of the rail 3 during straight movement and is in contact with the lateral surface 3*d* of the rail 3 only during curved movement is additionally developed. This embodiment is shown in FIGS. 9 to 11, and is useful to a reduction in the outer diameter D1, wear prevention, and an increase in durability of the guide roller 122 compared to the embodiment shown in FIG. 7.

Figure 9:
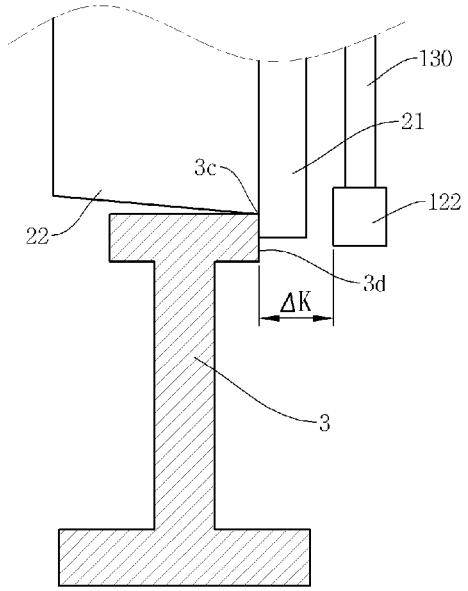
FIGS. 9 to 11 are explanatory views that explain self-steering capability of the embodiment shown in FIG. 8.
Figure 10:
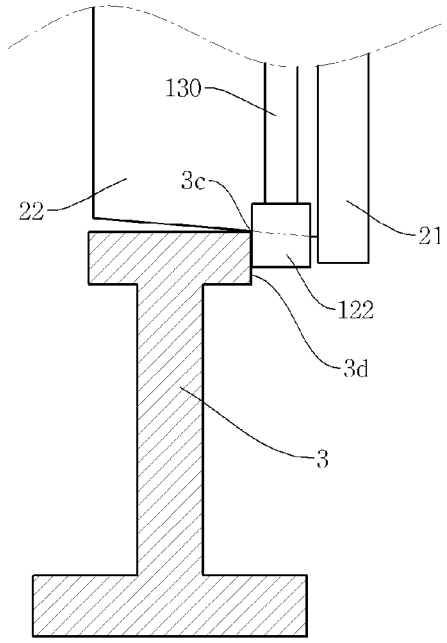
Figure 11:
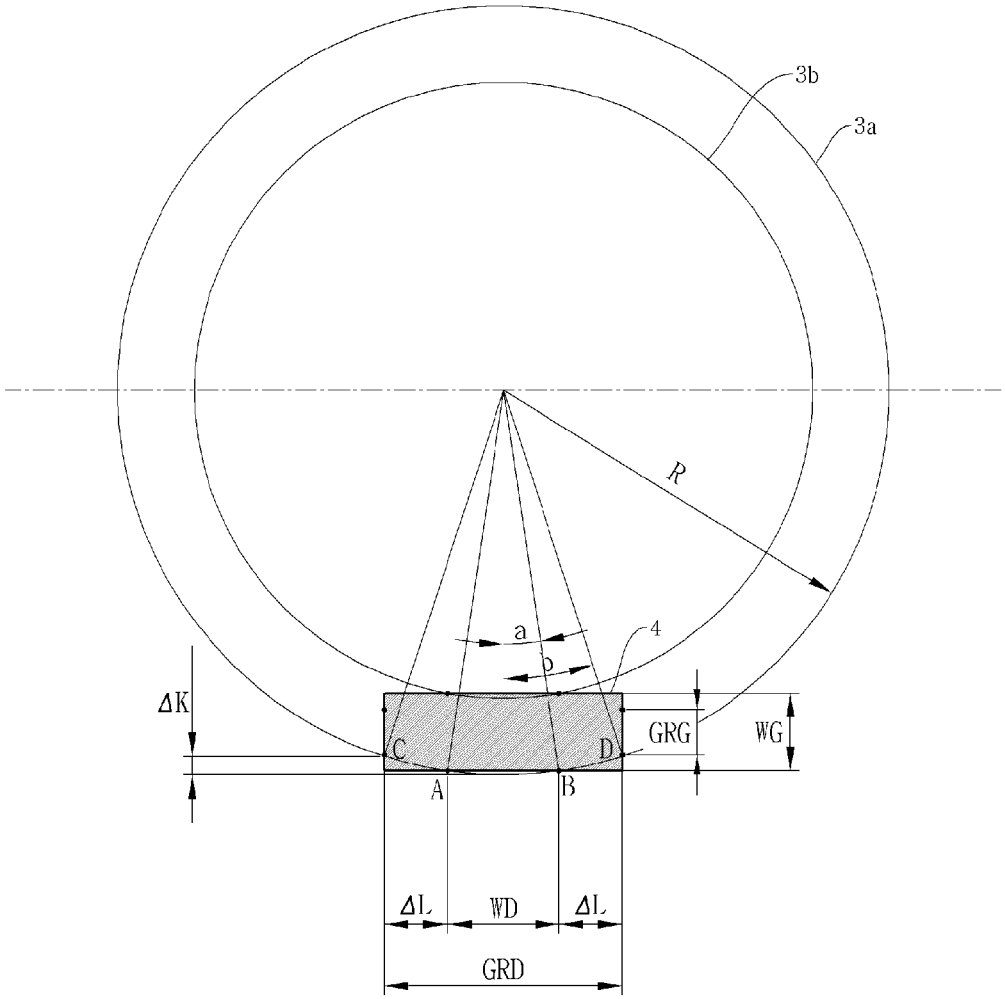

In this way, the embodiment shown in FIGS. 9 to 11 is to dispose the guide roller 122 inside the wheel flange 21. In detail, a guide roller gauge GRG that is an axle-direction spaced distance between the guide rollers 122, is shorter than a wheel flange gauge WG that is an axle-direction spaced distance between the wheel flanges 21. This is one of the important features of the present invention. Since the present invention is at least configured so that the guide roller gauge is shorter than or equal to the wheel flange gauge, a degree to which the guide roller is in contact with the lateral surface of the rail during straight movement is suppressed to the utmost, and thus the reliability of long-term durability of the guide roller having a small diameter can be ensured.

FIG. 9 shows a position relation of the wheel flange 21, the guide roller 122, and the rail 3 during straight movement. Referring to FIG. 9, during straight movement of the railway vehicle 1, depending on a difference 2ΔK between the guide roller gauge GRG and the wheel flange gauge WG, the guide roller 122 is separated from the lateral surface 3*d* of the rail 3, and the wheel flange 21 is in contact with the lateral surface 3*d* of the rail 3. Since the guide roller 122 is not at all subjected to either the vertical load or the transverse load during straight movement, even when the railway vehicle 1 moves on the straight rails 3 at high speed, the guide roller 122 is neither worn nor generates contact noise.

FIG. 10 shows a position relation of the wheel flange 21, the guide roller 122, and the rail 3 during curved movement. In the embodiment shown in FIGS. 9 to 11, during traveling on a smooth curve where the curvature of the rail 3 is less than a predetermined value, or during moving on the straight rail 3, the guide roller 122 is not in contact with the rail 3. The guide roller 122 is in contact with the rail 3 only when the curvature of the rail 3 is more than a predetermined value and thus the transverse load is more than a predetermined value, thereby supporting the transverse load caused by the centrifugal force.

In detail, when the curved degree (curvature) of the rail 3 is small, the guide roller 122 is not in contact with the rail 3. However, when the curvature of the rail 3 is great, the wheel flange 21 is separated from the lateral surface 3*d* of the rail 3 according to the geometrical disposition structure, and the guide roller 122 is in contact with the lateral surface 3*d* of the rail 3. In the event of contact between the guide roller 122 and the rail 3, the wheel flange 21 is separated, and is not subjected to the transverse load. Thus, the squealing noise of the wheel flange 21 is not generated, and the guider roller 122 supports the transverse load while being in rolling contact.

Referring to FIG. 11, a method of setting ΔK corresponding to a half of the difference between the wheel flange gauge WG and the guide roller gauge GRG according to a radius of curvature is shown.

A spaced distance between the axles 6 in the lengthwise direction of the railway vehicle 1 is defined as an inter-axle distance WD, and a spaced distance between the guide rollers 122 in the lengthwise direction of the railway vehicle 1 is defined as a guide roller inter-axis distance GRD. Further, a spaced distance between the wheel flange 21 and the guide roller 122 6 in a direction of the axle 6 is defined as ΔK.

Further, it is defined that the wheel flange 21 begins to be separated from the lateral surface 3*d* of the rail 3 only when the radius of curvature of the rail 3 is less than or equal to a threshold value R. That is, when the radius of curvature of the rail 3 is less than the threshold value R, or when the rail 3 is straight, the wheel flange 21 is in contact with the lateral surface 3*d* of the rail 3, and the guide roller 122 is not in contact with the rail 3.

Here, the following equations are formed.

$$R \times \sin\alpha = \frac{WD}{2} \quad \text{Equation 1}$$

$$R \times \sin b = \Delta L + \frac{WD}{2} \quad \text{Equation 2}$$

$$\Delta K_{max} = R \times \cos\alpha - R \times \cos b \quad \text{Equation 3}$$

Arranging Equations 1 to 3, Equation 4 below is formed.

$$\Delta K_{max} = \sqrt{\left(R^2 - \frac{WD^2}{4}\right)} - \sqrt{\left(R^2 - \frac{GRD^2}{4}\right)} \quad \text{Equation 4}$$

ΔK is selected from values from 0 to $\Delta K_{max}$. Thus, only when the radius of curvature of the rail 3 is less than or equal to the threshold value R does the wheel flange 21 begin to be separated from the lateral surface 3*d* of the rail 3. When the radius of curvature of the rail 3 is less than the threshold value R, or when the rail 3 is straight, the wheel flange 21 is in contact with the lateral surface 3*d* of the rail 3, and the guide roller 122 is not in contact with the rail 3.

As a result, even when the railway vehicle 1 moves on the straight rails 3 or the small-curvature rails 3 at high speed, the guide roller 122 is neither worn nor generates contact noise, and the service durability and reliability of the guide roller 122 are improved. Only when the curvature, that is, the reciprocal number of the radius of curvature, is more than or equal to a predetermined value, does the guide roller 122 support the transverse load, and the wheel flange 21 is thus separated from the lateral surface 3*d* of the rail 3.

Figure 12:
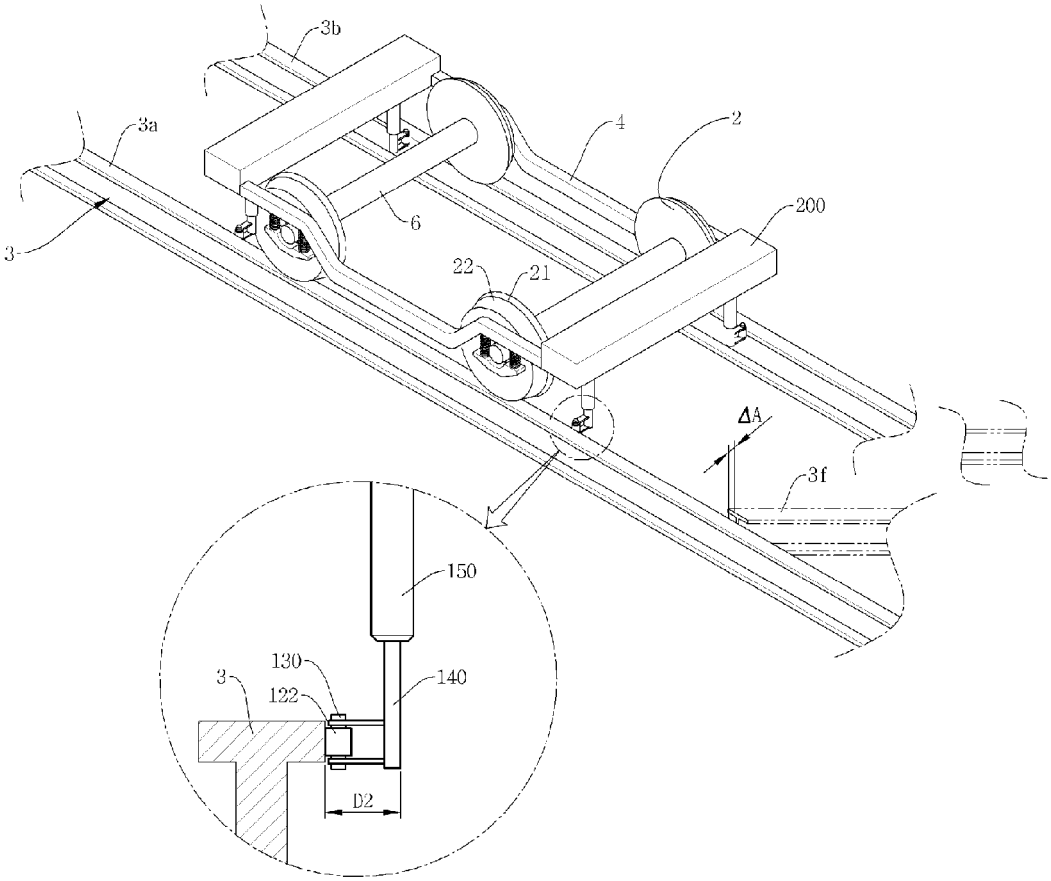
FIGS. 12 and 13 are perspective views showing various embodiments of the present invention.

Meanwhile, in an embodiment of FIG. 12, a bracket 140 is installed. The bracket 140 is a structure in which one end thereof is coupled to the rotational shaft 130 of the guide roller 122 and the other end thereof is connected to the truck 4. In FIG. 12, the rotational shaft 130 of the guide roller 122 is installed so as to be perpendicular to the axle 6 or to be parallel to the lateral surface 3*d* of the rail 3 when viewed from the front of the railway vehicle 1. When the bracket 140 is installed, this has an advantage that the coupling structure of the guide roller 122 and the truck 4 can be freely designed so as to be suitable for the shape or purpose of the railway vehicle 1.

When a size D2 of the bracket 140 is great, the bracket 140 may interfere with the connection gap ΔA. As such, an actuator 150 is provided so as to raise the bracket 140 before the guide roller 122 reaches the connection gap ΔA. The actuator 150 may include a hydraulic cylinder, a pneumatic cylinder, or a solenoid whose operation is controlled by a controller 200. When the bracket 140 is raised by the actuator 150, this has an advantage that the interference of the bracket 140 with the connection gap ΔA can be prevented and that the coupling structure of the guide roller 122 and the truck 4 can be flexibly deformed.

Regardless of the existence of the connection gap ΔA, when the rotational shaft 130 of the guide roller 122 is installed so as to be perpendicular to the axle 6 or to be parallel to the lateral surface 3*d* of the rail 3 when viewed from the front of the railway vehicle 1, the bracket 140 allows the guide roller 122 to be separated from or to come into contact with the rail 3 while being raised or lowered by the actuator 150.

Figure 13:
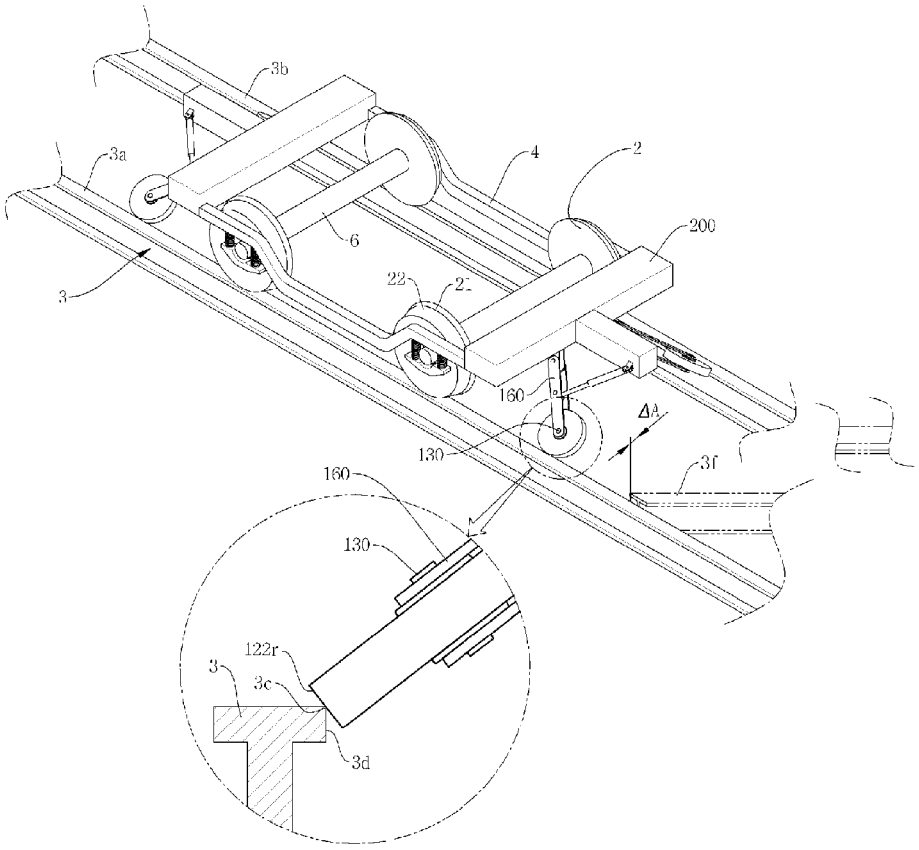

Meanwhile, in FIG. 13, an embodiment in which the rotational shaft 130 of the guide roller 122 is installed so as to be inclined is shown. In detail, the rotational shaft 130 of the guide roller 122 is installed so as to be inclined to the axle 6 and the lateral surface 3*d* of the rail 3 when viewed from the front of the railway vehicle 1. Here, the guide roller 122 is in rolling contact with the top surface edge 3*c* of the rail 3. Even in this embodiment, the guide roller 122 is only in point or line contact with the top surface edge 3*c* of the rail 3 without surface contact. Thus, the interference section 30 (FIGS. 2 and 30 of FIG. 3) or the frictional surface of the wheel flange 21 with the rail 3 is not formed.

This embodiment has an advantage that the outer diameter of the guide roller 122 can be increased regardless of the size of the connection gap ΔA. An outer circumferential surface of the guide roller 122 may become a convex or concave curved surface (not shown), in addition to a flat surface, with respect to the top surface edge 3*c* of the rail 3 as shown in FIG. 13 so as to allow the guide roller 122 to sufficiently support the transverse load and improve wear resistance in contact with the top surface edge 3*c* of the rail 3.

When the rotational shaft 130 of the guide roller 122 is installed so as to be inclined and the outer diameter of the guide roller 122 is great as in FIG. 13, the passing through the connection gap ΔA may become an issue. Thus, as an embodiment for preventing this, a link 160 and an actuator 150 for pivoting the link 160 are provided.

The link 160 is installed so as to be inclined to the axle 6 and the lateral surface 3*d* of the rail 3 when viewed from the front of the railway vehicle 1. An outer circumference 122*r* of the guide roller 122 is in rolling contact with the top surface edge 3*c* of the rail 3.

The link 160 is configured so that one end thereof is coupled to the rotational shaft 130 of the guide roller 122, and the other end thereof is pivotably fixed to the truck 4. The actuator 150 pivots the link 160 relative to the truck 4. The link 160 and the actuator 150 are controlled by the controller 200.

The controller 200 pivots the link 160 in an upward direction before the guide roller 122 reaches the connection gap ΔA, thereby preventing the guide roller 122 from inhibiting traveling due to contact interference with the connection gap ΔA.

Thus, even when the truck 4 fluctuates during the movement of the railway vehicle 1, the fluctuation freely occurs within a predetermined range between the guide roller 122 and the top surface edge 3*c* of the rail 3. Thus, the movement resistance can be prevented.

Next, operations and merits of the self-steering device for a railway vehicle in accordance with the embodiment of the present invention will be summarized.

In the embodiment shown in FIG. 8, during curved movement, the guide roller 122 is in rolling contact with the lateral surface 3*d* of the rail 3, and the wheel flange 21 is separated from the lateral surface 3*d* of the rail 3. During straight movement, the wheel flange 21 faces the lateral surface 3*d* of the rail 3 to prevent derailing regardless of the contact between the guide roller 122 and the lateral surface 3*d* of the rail 3.

None of the operations are based on separate external force except for two features, one of which is the geometrical disposition structure of the wheel flange 21 and the guide roller 122 and the other of which is the rolling contact characteristic of the guide roller 122. The guide roller 122 can pass through the connection gap ΔA and sufficiently withstand the transverse load. In principle, means for raising/lowering the guide roller 122 is not required.

An example of the guide roller 122 may include a needle bearing. The needle bearing has a sufficiently great inner diameter, so that the rotational shaft 130 of the guide roller 122 can be sufficiently increased in diameter d, and the guide roller 122 can be sufficiently reduced in outer diameter D1 to pass through the connection gap ΔA.

In the embodiment shown in FIGS. 9 and 11, the guide roller 122 is installed inside the wheel 2. That is, the guide roller gauge GRG is shorter than the wheel flange gauge WG. Thus, the guide roller 122 is not in contact with the rail 3 on a straight movement track or a track having a large radius of curvature, and is in contact with the lateral surface 3*d* of the rail 3 only on an greatly curved track where the radius of curvature is less than or equal to the threshold value R.

Accordingly, the guide roller 122 is greatly increased in wear resistance and reliability, and the interference sections 30 of the wheel flange 21 and the rail 3 are not generated during curved movement. The spaced distance ΔK between the wheel flange 21 and the guide roller 122 in an axle direction is determined according to a correlation between the inter-axle distance WD, the guide roller inter-axis distance GRD, and the threshold value R of the radius of curvature of the rail 3.

In the embodiment shown in FIG. 12, to give variability to the installation structure of the guide roller 122, the guide roller 122 is installed on the bracket 140, and the bracket 140 is raised/lowered by the actuator 150. When meeting the connection gap ΔA, the bracket 140 is raised by the actuator 150 so that the guide roller 122 and the bracket 140 are not caught in the connection gap ΔA. Further, the bracket 140 that is the coupling structure of the guide roller 122 and the truck 4 can be freely designed, so that the supporting efficiency of the transverse load can be considerably improved during curved movement.

In the embodiment shown in FIG. 13, there is an advantage that the shape of the guide roller 122 can be diversified, and the various contact portions such as the lateral surface 3*d* and the top surface edge 3*c* of the rail 3 can be selected according to the shape. When the outer diameter of the guide roller 122 is increased, a hydraulic cylinder (not shown) capable of raising/lowering the rotational shaft 130 of the guide roller 122 is installed, so that the guide roller 122 can be raised when passing through the connection gap ΔA.

Even when the rotational shaft 130 of the guide roller 122 is installed so as to be inclined, the guide roller 122 is in contact with the top surface edge 3*c* of the rail 3, and the link 160 can be pivoted near the connection gap ΔA. As such, there is no limitation to the outer diameter of the guide roller 122. The outer diameter of the guide roller 122 can be increased as needed, and thus the wear resistance and reliability of the guide roller 122 can be improved. The guide roller 122 is not in conflict with the size of the connection gap ΔA.

The structure in which the hydraulic cylinder (not shown) is installed so as to be able to raise/lower the rotational shaft 130 of the guide roller 122 gives an advantage in that the guide roller 122 can be designed in a desired shape regardless of the outer diameter of the guide roller 122 or the size of the connection gap ΔA and the installation structure of the guider roller 122 and its rotational shaft 130 can be variously changed in design.

Figure 14:
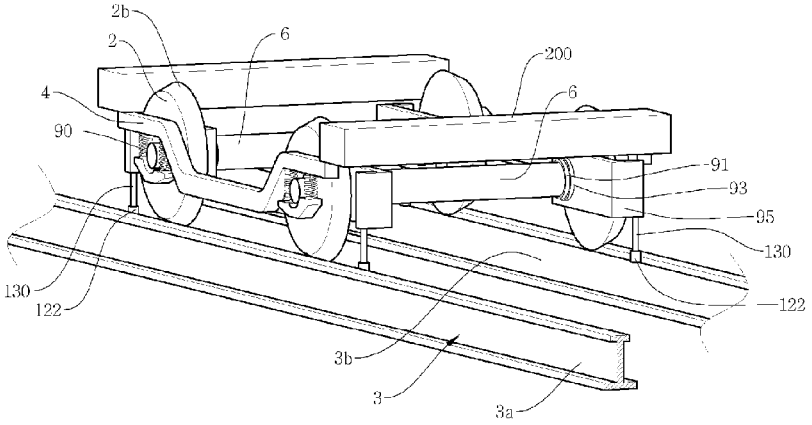
FIG. 14 is a perspective view showing an embodiment in which the guide rollers are connected to the axles as one embodiment of the present invention.

FIG. 14 is a perspective view showing an embodiment in which the guide rollers 122 are installed on the axles 6 as one embodiment of the present invention. To absorb shock or vibration of a road surface during the movement of the railway vehicle, the truck 4 is supported by suspensions 90. Since the wheel 2 is in contact with the rail 3, the wheel 2 and the axle 6 maintain a fixed height with respect to the rail 3, but the truck 4 continues to move on the rail 3 in a vertical direction without maintaining a fixed height during the movement of the railway vehicle.

Here, when the guide roller 122 and its rotational shaft 130 are fixed to the truck 4, a position at which the guide roller 122 is in contact with the rail 3 may continue to vary during the movement of the railway vehicle. To improve this, the guide roller 122 may be connected to the axle 6. That is, by connecting the rotational shaft 130 of the guide roller 122 to the axle 6, the guide roller 122 and the axle 6 are allowed to maintain a fixed height with respect to the rail 3 during the movement of the railway vehicle.

In detail, the rotational shaft 130 of the guide roller 122 is fixed to a fixing structure 95, and the fixing structure 95 is connected to the axle 6 via a bearing 93. To fix positions of the fixing structure 95 and the bearing 93, a stopper 91 may be used. The axle 6 rotates together with the wheel 2, and the fixing structure 95 maintains a fixed height with respect to the rail 3 in spite of the rotation of the axle 6. The fixing structure 95 maintains a fixed height with respect to the axle 6 in a height direction. To this end, a stabilizer (not shown) for preventing the rotation of the fixing structure 95 and keeping a horizontal posture of the fixing structure 95 may be installed between the fixing structure 95 and the truck 4.

Figure 15:
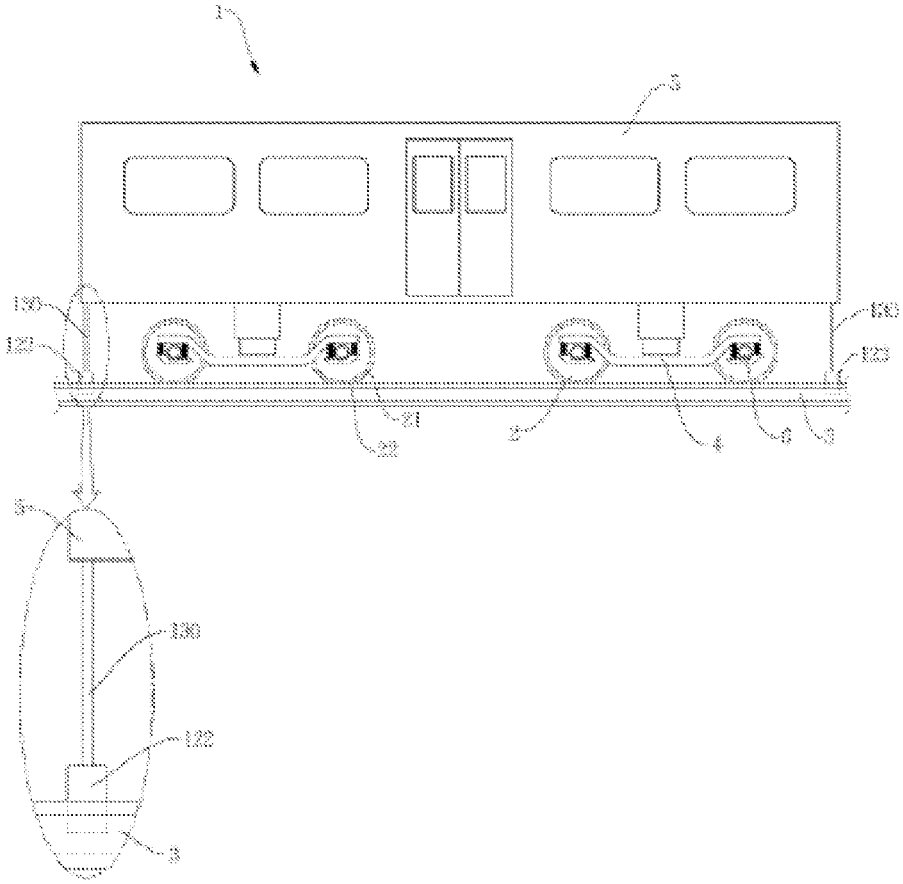
FIG. 15 is a side view showing an embodiment in which the guide rollers are directly attached to the railway vehicle as one embodiment of the present invention.

FIG. 15 is a side view showing an embodiment in which the guide rollers are directly attached to the railway vehicle or the vehicle body as one embodiment of the present invention. Referring to FIG. 15, the guide rollers are disposed in the front and rear of the railway vehicle respectively, and are directly attached to the railway vehicle 1 or the vehicle body 5. In this case, the number of installed guide rollers can be minimized. For example, only four guide rollers 122 are required for one railway vehicle 1. In comparison with the case in which the guide rollers 122 are attached to the truck 4, the guide rollers 122 may be directly attached to the railway vehicle 1 or the vehicle body 5 without changing a structure of the truck 4. That is, this has an advantage that it is not necessary to modify the truck 4 or to change the structure of the truck 4, and that the guide rollers 122 are directly attached to the front or rear of the railway vehicle 1 or the vehicle body 5 with an existing structure of the railway vehicle 1 or the vehicle body 5 maintained without a change. Thus, the guide rollers can be directly installed on the railway vehicle or at least one of the vehicle body, the truck, and the axle.

Although the embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A self-steering device for a railway vehicle, including:

axles installed on a truck supporting a vehicle body of the railway vehicle;

wheels connected to the axles, each wheel having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section; and guide rollers, each of which is in rolling contact with a top surface edge or a lateral surface of the rail in front or to the rear of the wheel when the railway vehicle enters curved rails and supports a greater transverse load than the interference section;

wherein a guide roller gauge that is an axle-direction spaced distance between the guide rollers, is shorter than a wheel flange gauge that is an axle-direction spaced distance between the wheel flanges, and during the straight movement of the railway vehicle, according to a difference between the guide roller gauge and the wheel flange gauge, the guide roller is separated from the lateral surface of the rail and the wheel flange is in contact with the lateral surface of the rail, whereas during the curved movement of the railway vehicle, according to the difference between the guide roller gauge and the wheel flange gauge, the wheel flange is separated from the lateral surface of the rail and the guide roller is in contact with the lateral surface of the rail.

2. The self-steering device according to claim 1, wherein each guide roller separates the wheel flange from the lateral surface of the rail during curved movement of the railway vehicle.

3. The self-steering device according to claim 1, wherein the guide rollers are disposed in the front and rear of the railway vehicle respectively, and are directly fixed to the railway vehicle.

4. The self-steering device according to claim 1, wherein, when the first and second wheels are sequentially arranged from a front of the truck, the guide rollers are disposed in front of the first wheel and to the rear of the second wheel respectively.

5. The self-steering device according to claim 1, wherein, when a spaced distance between the axles in a lengthwise direction of the railway vehicle is defined as an inter-axle distance (WD), when a spaced distance between the guide rollers in the lengthwise direction of the railway vehicle is defined as a guide roller inter-axis distance (GRD), when a spaced distance between the wheel flange and the guide roller in a direction of the axle is defined as ΔK, and when the wheel flange begins to be separated from the lateral surface of the rail only when a radius of curvature of the rail is less than or equal to a threshold value (R), a maximum value ($\Delta K_{max}$) of ΔK is obtained by an equation below:

$$\Delta K_{max} = \sqrt{\left(R^2 - \frac{WD^2}{4}\right)} - \sqrt{\left(R^2 - \frac{GRD^2}{4}\right)}$$

where ΔK is selected from values from 0 to $\Delta K_{max}$.

6. The self-steering device according to claim 1, wherein each guide roller has a rotational shaft that is perpendicular to the axle or is parallel to the lateral surface of the rail when viewed from the front of the railway vehicle.

7. The self-steering device according to claim 6, wherein the guide roller has at least one of a cylinder shape, a cone shape, a truncated cone shape, or a combined shape of the cylinder shape and the cone shape.

8. The self-steering device according to claim 1, wherein each guide roller has a rotational shaft that is installed so as to be inclined to the axle and the lateral surface of the rail when viewed from the front of the railway vehicle.

9. The self-steering device according to claim 8, wherein the guide roller has an outer circumferential surface that is at least one of a flat surface, a convex surface, and a concave curved surface with respect to the top surface edge of the rail.

10. A self-steering device for a railway vehicle, including:

axles installed on a truck supporting a vehicle body of the railway vehicle;

wheels connected to the axles, each wheel having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section; and guide rollers, each of which is in rolling contact with a top surface edge or a lateral surface of the rail in front or to the rear of the wheel when the railway vehicle enters curved rails and supports a greater transverse load than the interference section;

wherein each guide roller has a rotational shaft that is perpendicular to the axle or is parallel to the lateral surface of the rail when viewed from the front of the railway vehicle;

wherein, when a connection gap exists in a portion where one rail intersects with another rail so as to allow the wheel flange to pass through, the guide roller has a smaller outer diameter than a size of the connection gap.

11. A self-steering device for a railway vehicle, including:

axles installed on a truck supporting a vehicle body of the railway vehicle;

wheels connected to the axles, each wheel having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section; and guide rollers, each of which is in rolling contact with a top surface edge or a lateral surface of the rail in front or to the rear of the wheel when the railway vehicle enters curved rails and supports a greater transverse load than the interference section;

wherein each guide roller has a rotational shaft that is perpendicular to the axle or is parallel to the lateral surface of the rail when viewed from the front of the railway vehicle;

wherein the guide roller includes a needle bearing having an inner race fitted around an end of the rotational shaft and an outer race being in rolling contact with the lateral surface of the rail.

12. A self-steering device for a railway vehicle, including:

axles installed on a truck supporting a vehicle body of the railway vehicle;

wheels connected to the axles, each wheel having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section;

guide rollers, each of which is in rolling contact with a top surface edge or a lateral surface of the rail in front or to the rear of the wheel when the railway vehicle enters curved rails and supports a greater transverse load than the interference section;

a bracket, one end of which is coupled to a rotational shaft of each guide roller which is installed so as to be perpendicular to the axle or to be parallel to the lateral surface of the rail when viewed from the front of the railway vehicle, and the other end of which is connected to the truck; and an actuator that, when a connection gap exists in a portion where one rail intersects with another rail so as to allow the wheel flange to pass through, raises the bracket before the guide roller reaches the connection gap.

13. A self-steering device for a railway vehicle, including:

axles installed on a truck supporting a vehicle body of the railway vehicle;

wheels connected to the axles, each wheel having a wheel tread moving on a top surface of a rail and supporting a vertical load of the railway vehicle, and a wheel flange protruding from the wheel tread to prevent the railway vehicle from derailing and being in contact with a lateral surface of the rail during straight movement of the railway vehicle to form an interference section;

guide rollers, each of which is in rolling contact with a top surface edge or a lateral surface of the rail in front or to the rear of the wheel when the railway vehicle enters curved rails and supports a greater transverse load than the interference section, wherein each guide roller has a rotational shaft that is installed so as to be inclined to the axle and the lateral surface of the rail when viewed from the front of the railway vehicle;

a link, one end of which is coupled to a rotational shaft of each guide roller, and the other end of which is pivotably connected to the truck, and an actuator pivoting the link;

wherein, an outer circumference of the guide roller is in rolling contact with the top surface edge of the rail.

14. The self-steering device according to claim 13, wherein, when a connection gap exists in a portion where one rail intersects with another rail so as to allow the wheel flange to pass therethrough, the actuator operates to pivot the link in an upward direction before the guide roller reaches the connection gap.

15. A self-steering device for a railway vehicle, including:

axles installed on a truck supporting a vehicle body of the railway vehicle;

wheels rotating around the respective axles, running along a rail, and each having a protruding wheel flange facing a lateral surface of the rail to prevent the railway vehicle from derailing; and guide rollers disposed respectively in the front and rear of the truck in a lengthwise direction of the railway vehicle with the wheel between them;

wherein, when a radius of curvature of the rail is reduced, the guide roller supports a transverse load of the railway vehicle, and the wheel flange is separated from the rail;

wherein, when a spaced distance between the axles in the lengthwise direction of the railway vehicle is defined as an inter-axle distance (WD), and when a spaced distance between the guide rollers in the lengthwise direction of the railway vehicle is defined as a guide roller inter-axis distance (GRD), the guide roller inter-axis distance (GRD) is farther than the inter-axle distance (WD).

16. The self-steering device according to claim 15, wherein the guide roller is connected to the axle, and the guide roller and the axle maintain a fixed height with respect to the rail during movement of the railway vehicle.

17. A self-steering device for a railway vehicle, including:

axles installed on a truck supporting a vehicle body of the railway vehicle;

wheels rotating around the respective axles, running along a rail, and each having a protruding wheel flange facing a lateral surface of the rail to prevent the railway vehicle from derailing; and guide rollers disposed respectively in the front and rear of the truck in a lengthwise direction of the railway vehicle with the wheel between them;

wherein, when a radius of curvature of the rail is reduced, the guide roller supports a transverse load of the railway vehicle, and the wheel flange is separated from the rail;

wherein a guide roller gauge that is an axle-direction spaced distance between the guide rollers is shorter than a wheel flange gauge that is an axle-direction spaced distance between the wheel flanges, and according to a difference between the guide roller gauge and the wheel flange gauge, the wheel flange begins to be separated from the lateral surface of the rail only when a radius of curvature of the rail is less than or equal to a threshold value (R).

18. A self-steering device for a railway vehicle, including:

axles installed on a truck supporting a vehicle body of the railway vehicle;

wheels rotating around the respective axles, running along a rail, and each having a protruding wheel flange facing a lateral surface of the rail to prevent the railway vehicle from derailing; and guide rollers disposed respectively in the front and rear of the truck in a lengthwise direction of the railway vehicle with the wheel between them;

wherein, when a radius of curvature of the rail is reduced, the guide roller supports a transverse load of the railway vehicle, and the wheel flange is separated from the rail;

wherein, when a connection gap exists in a portion where one rail intersects with another rail so as to allow the wheel flange to pass through, the guide roller has a smaller outer diameter than a size of the connection gap.

* * * * *